US009233272B2

(12) United States Patent
Villani et al.

(10) Patent No.: US 9,233,272 B2
(45) Date of Patent: Jan. 12, 2016

(54) TREADMILL WITH MANUALLY ADJUSTABLE MAGNETIC RESISTANCE SYSTEM AND MANUALLY ADJUSTABLE ANGLE OF INCLINATION

(71) Applicants: Anthony J. Villani, Delray Beach, FL (US); Mark Drucker, Deerfield Beach, FL (US)

(72) Inventors: Anthony J. Villani, Delray Beach, FL (US); Mark Drucker, Deerfield Beach, FL (US)

(73) Assignee: SHREDMILL LLC, Delray Beach, FL (US)

( * ) Notice: Subject to any disclaimer, the term of this patent is extended or adjusted under 35 U.S.C. 154(b) by 0 days.

(21) Appl. No.: 14/027,864

(22) Filed: Sep. 16, 2013

(65) Prior Publication Data

US 2015/0080189 A1 Mar. 19, 2015

(51) Int. Cl.
*A63B 22/02* (2006.01)

(52) U.S. Cl.
CPC ..... *A63B 22/02* (2013.01)

(58) Field of Classification Search
CPC ..... A63B 22/02; A63B 22/0235; A63B 2210/50; A63B 22/0023; A63B 22/0285; A63B 2022/0214; A63B 2022/0292; A63B 22/0242; A63B 24/0087; A63B 2022/0228
USPC ..... 482/51, 54, 1–9
See application file for complete search history.

(56) References Cited

U.S. PATENT DOCUMENTS

| | | | | |
|---|---|---|---|---|
| 759,296 | A * | 5/1904 | Moriarty | 482/54 |
| 3,643,943 | A * | 2/1972 | Erwin et al. | 482/8 |
| 4,151,988 | A | 5/1979 | Nabinger | |
| 4,344,616 | A * | 8/1982 | Ogden | 482/54 |
| 4,374,587 | A * | 2/1983 | Ogden | 482/54 |
| 4,502,679 | A * | 3/1985 | De Lorenzo | 482/7 |
| 4,625,962 | A * | 12/1986 | Street | 482/116 |
| 4,659,074 | A * | 4/1987 | Taitel et al. | 482/54 |
| 4,974,831 | A | 12/1990 | Dunham | |
| 5,007,630 | A * | 4/1991 | Real et al. | 482/54 |
| 5,346,451 | A * | 9/1994 | Miller | 482/112 |
| 6,045,490 | A | 4/2000 | Shafer et al. | |
| 7,207,926 | B2 | 4/2007 | Hoag | |
| 8,585,561 | B2 * | 11/2013 | Watt et al. | 482/57 |
| 8,845,494 | B2 * | 9/2014 | Whitall et al. | 482/8 |
| 2006/0035757 | A1 * | 2/2006 | Flick et al. | 482/54 |
| 2013/0210582 | A1 * | 8/2013 | Del Toro et al. | 482/8 |

FOREIGN PATENT DOCUMENTS

EP 1 466 651 B1 5/2008

* cited by examiner

*Primary Examiner* — Stephen Crow
(74) *Attorney, Agent, or Firm* — Gordon Rees Scully Mansukhani LLP

(57) ABSTRACT

A treadmill, having: (a) a frame with front and rear rollers and a continuous tread wrapped therearound; (b) a flywheel connected to one of the front or rear rollers; and (c) a magnetic resistance unit positioned near the flywheel to provide resistance to rotation of the flywheel. The magnetic resistance unit is moved up and down by an operator to move a series of magnets to different positions near the flywheel such that the position of the magnets determines the amount of resistance provided to rotation of the flywheel.

19 Claims, 10 Drawing Sheets

TREADMILL WITH MANUALLY ADJUSTABLE MAGNETIC RESISTANCE SYSTEM AND MANUALLY ADJUSTABLE ANGLE OF INCLINATION

SUMMARY OF THE INVENTION

The present invention provides a manual treadmill having at least two important features not seen in prior designs. First, it has a resistance system that uses magnets to provide resistance to the rotation of a flywheel. By manually adjusting the position of the magnets, the user is able to easily adjust the resistance. Second, the angle of inclination of the treadmill can easily be adjusted by the user. An advantage of the present invention is that the user's own leg power moves the running surface. Thus, no motor is required. Moving against a variable resistance combined with a variable height/inclination determines which part of the user's running stride is worked on.

In preferred aspects, the present invention provides a treadmill, comprising: (a) a frame; (b) a front roller connected to the frame; (c) a rear roller connected to the frame; (d) a continuous tread wrapping around the front and rear rollers; (e) a flywheel connected to one of the front or rear rollers; and (f) a magnetic resistance unit positioned near the flywheel. The magnetic resistance unit provides resistance to rotation of the flywheel, and is manually moveable to different positions near the flywheel. As such, its position with respect to the flywheel corresponds to the amount of resistance provided to rotation of the flywheel In preferred aspects, the magnetic resistance unit comprises a plurality of magnets mounted to a magnet support member that is moveable up and down by moving a rod mounted to the magnet support member. The rod is preferably slidably connected to the frame such that an operator simply moves it up or down to change the resistance applied to the flywheel. An aluminum disk is mounted to the flywheel, with five axially magnetized neodymium magnets being used.

The present treadmill also includes a positioning system for manually varying the angle of the continuous tread. This positioning system preferably includes a positioning screw passing through the frame and a lower mount, such that a user on the treadmill simply has to rotate the screw to raise or lower the front of the treadmill (and therefore vary the angle of the continuous tread running surface).

An advantage of having both the resistance and the angle of inclination be manually adjustable by the runner on the device is that the runner is able to easily change speed, angle and running conditions, thereby working on different muscle groups at different times.

DETAILED DESCRIPTION OF THE DRAWINGS

Figure 1:
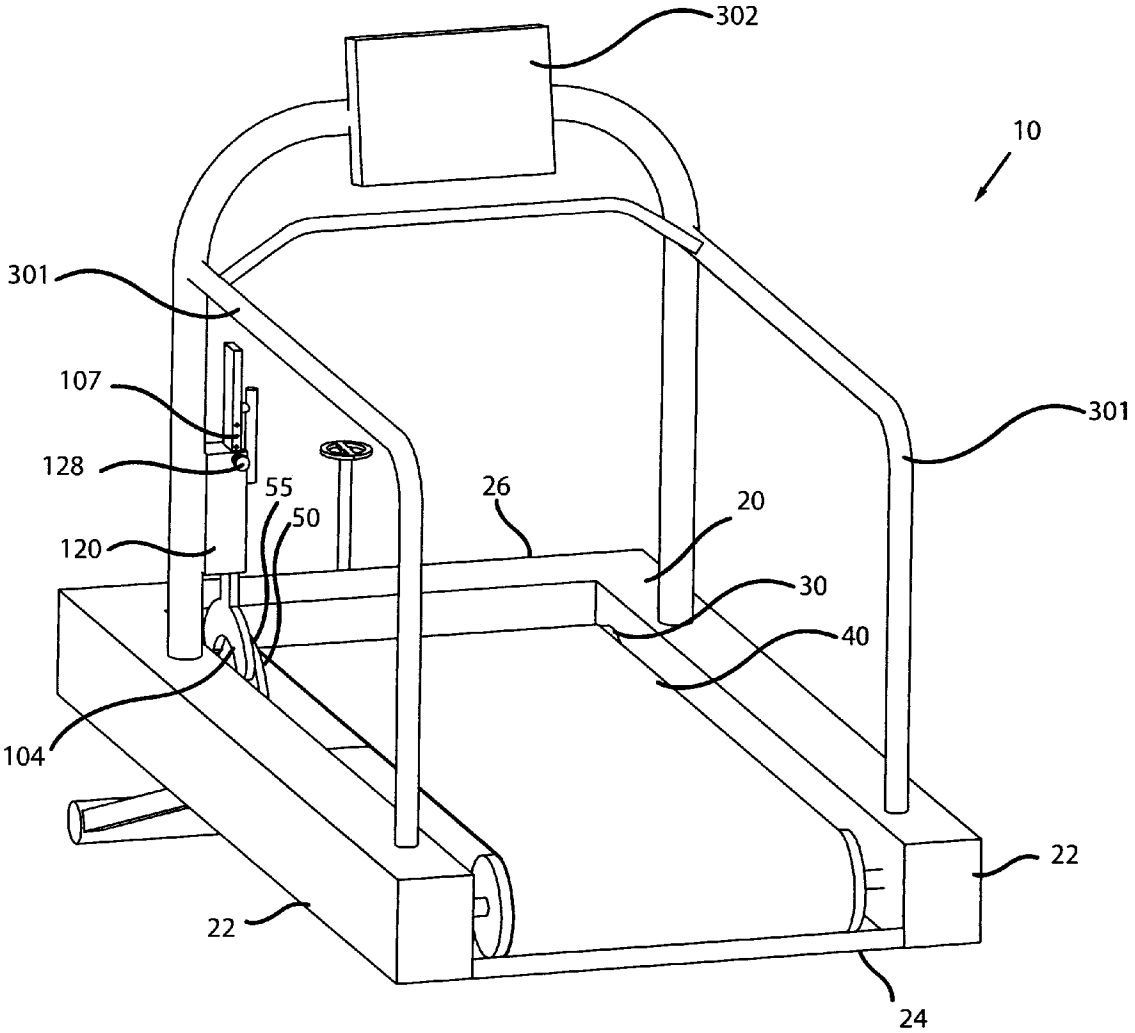
FIG. 1 is a rear perspective view of the treadmill.

The present invention provides a non-motorized treadmill that is manually adjustable both as to the resistance it provides to the runner and as to the angle of inclination of the treadmill running surface itself.

As seen in the attached Figures, treadmill 10 comprises a frame 20, a front roller 30, a rear roller 35; and a continuous tread 40 wrapping around the rollers. Frame 20 is made from side members 22, rear member 24 and front member 26.

The running deck below tread 40 may optionally be made of Ultra High Molecular Weight (UHMW) Polyethylene, or other suitable materials. The tread itself may optionally be made of PVC, or other suitable material.

A flywheel 50 is connected to front roller 30 as shown. The action of a runner on tread 40 causes front roller 30 and flywheel 50 to rotate. In preferred embodiments, an aluminum disk 55 is attached to flywheel 50.

Handrails 301 and a display unit 302 are also included.

The present treadmill provides a manually operable magnetic resistance system that permits an operator to easily select the amount of resistance that the treadmill provides. As will be shown, a magnetic resistance unit is connected to the frame and is moveable to different positions near the flywheel. The exact position of the magnetic resistance unit with respect to the flywheel corresponds to the amount of resistance provided to rotation of the flywheel, as follows.

FIGS. 5 to 7B illustrate the manually adjustable magnetic resistance system 100, as follows. Magnetic resistance unit 100 comprises: a magnet support member 104 and a rod 106. A plurality of magnets 110 are mounted to the magnet support member 104. The orientation of and spacing between the magnets determines the desired strength of the resistance effect.

Rod 106 is slidably received within a vertical beam 120 that is connected to side member 22 in frame 20. Rod 106 has a series of positioning sockets 107 running along its length and a positining pin 128 is provided on vertical beam 120. Rod 106 also has a positioning handle 109 mounted thereon, as shown.

Figure 6A:
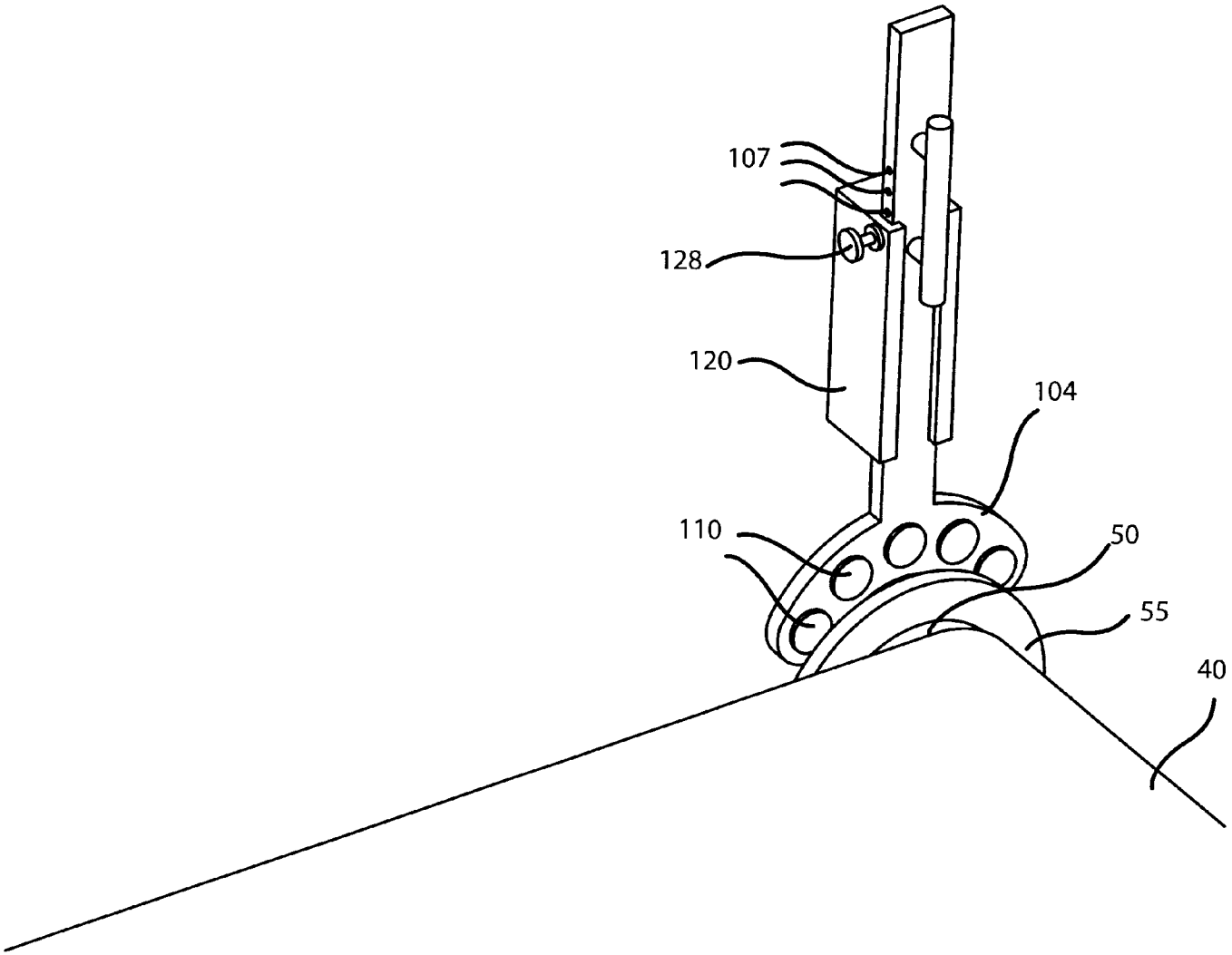
FIG. 6A is a perspective view of the area of the treadmill adjacent to the flywheel showing the magnetic resistance unit in a raised position.
Figure 6B:
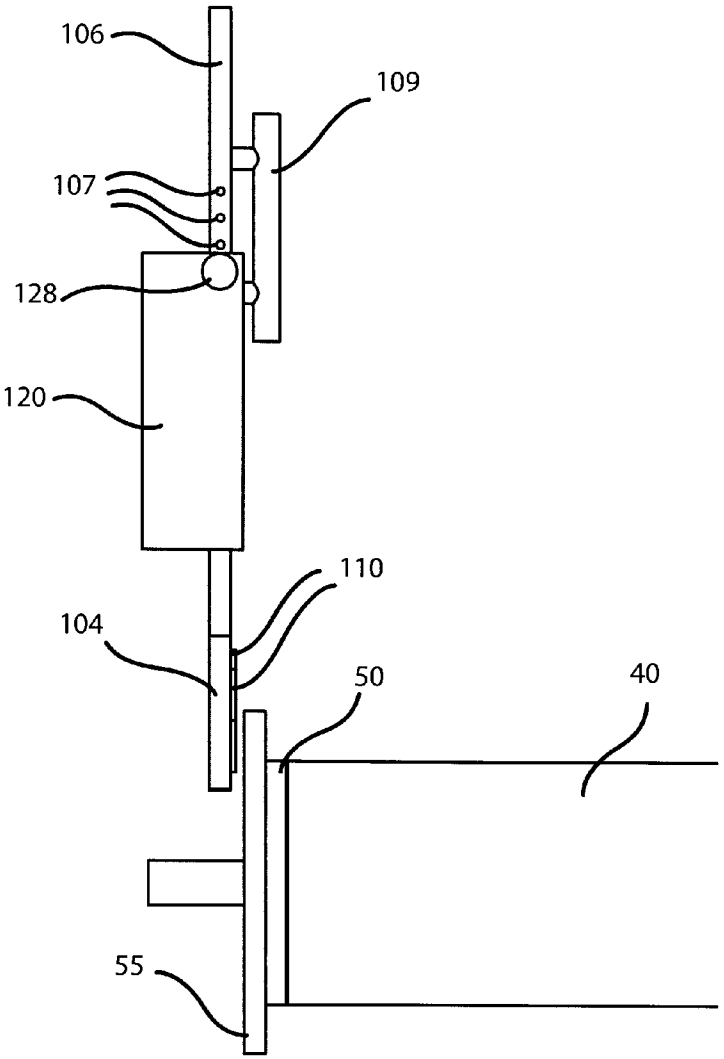
FIG. 6B is a side elevation view corresponding to FIG. 6A.

FIGS. 6A and 6B show the magnetic resistance unit 100 in a raised position. In this position, the magnets 110 provide only minimal resistance to the rotation of aluminum disk 55 and flywheel 50. To increase the resistance, the user slips positioning pin 128 out of one of positioning sockets 107, and then lowers rod 106 by handle 109 to the position shown in FIGS. 7A and 7B. Once the magnetic resistance unit 100 has been lowered to this position, the user then re-positions pin 128 in another positioning socket 107. As can be seen, the user is able to easily vary the position of the plurality of magnets 110 by moving rod 106 to different up and down positions.

Figure 7A:
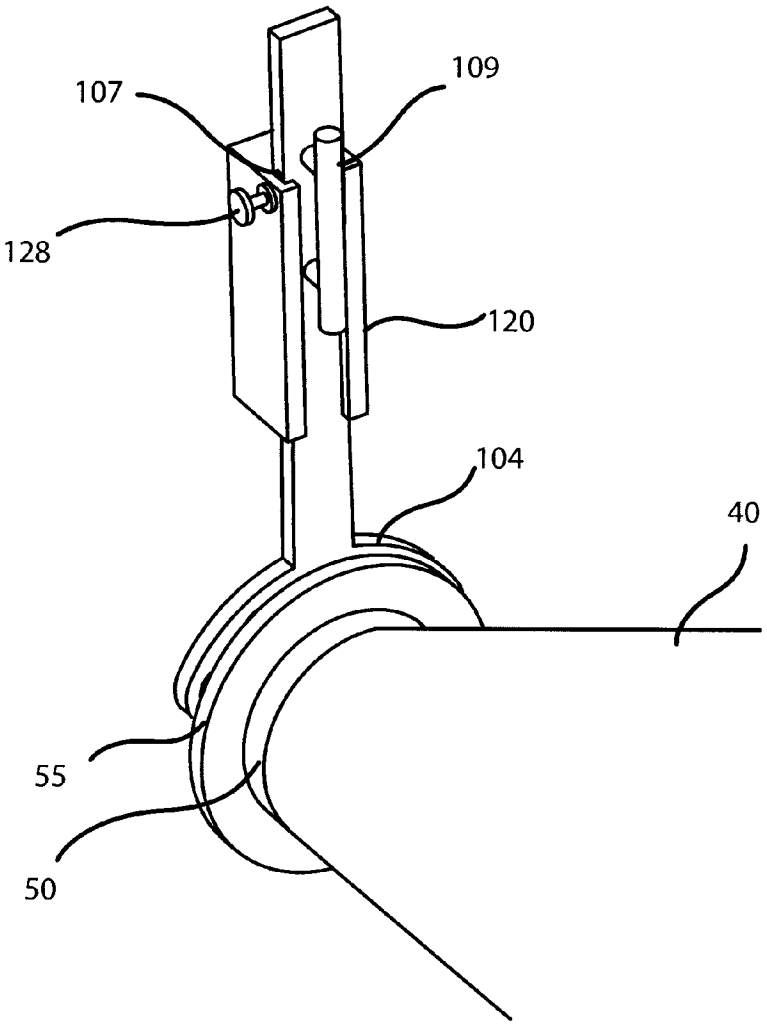
FIG. 7A is a perspective view of the area of the treadmill adjacent to the flywheel showing the magnetic resistance unit in a lowered position.
Figure 7B:
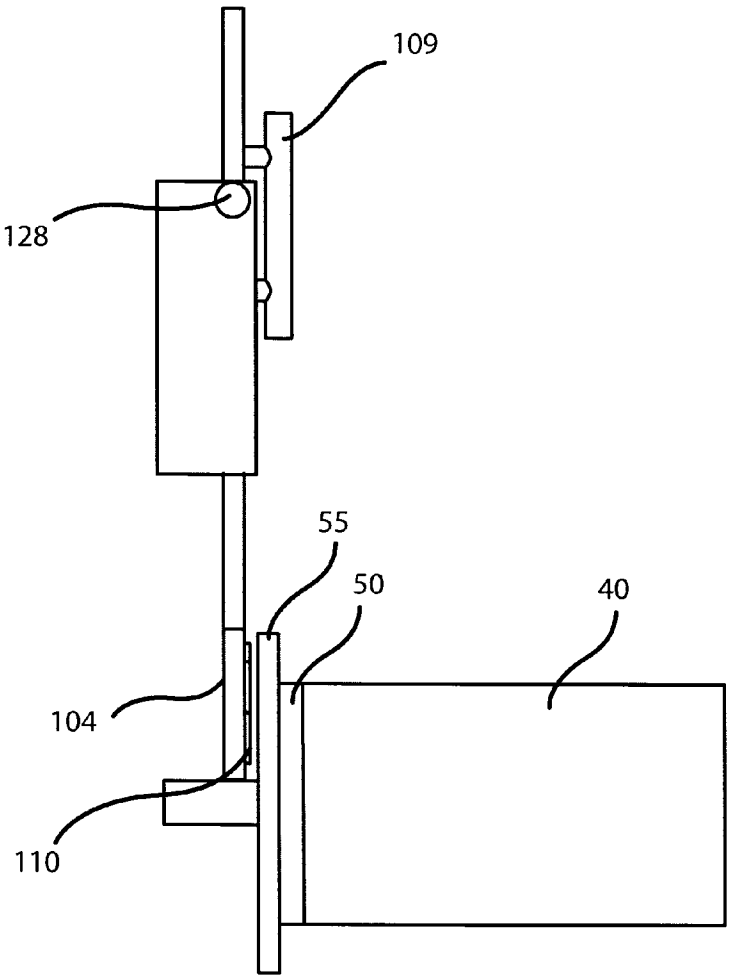
FIG. 7B is a side elevation view corresponding to FIG. 7A.

A number of positioning sockets 107 are provided on the side of rod 106 such that the location of magnets 110 with respect to flywheel 50 (and aluminum disk 55) can be set precisely. At each setting, a different amount of resistance to the rotation of flywheel 50 will be provided. FIGS. 6A and 6B show a position of minimal resistance, whereas FIGS. 7A and 7B show a position of increased resistance.

In operation, the resistance to rotation of aluminum disk 55 is created by an eddy current—caused by moving a magnetic field through an electric conductor.

In optional preferred embodiments, magnet support member 104 is Y-shaped and has five magnets 110 attached thereto, as shown. In one preferred embodiment, magnets 110 are made of neodymium, although other suitable materials may be used instead.

As can also be seen, electronic display 302 can show measurements including, but not limited to, runner's speed, power, distance covered, or countdown or countup timer functions.

Figure 2A:
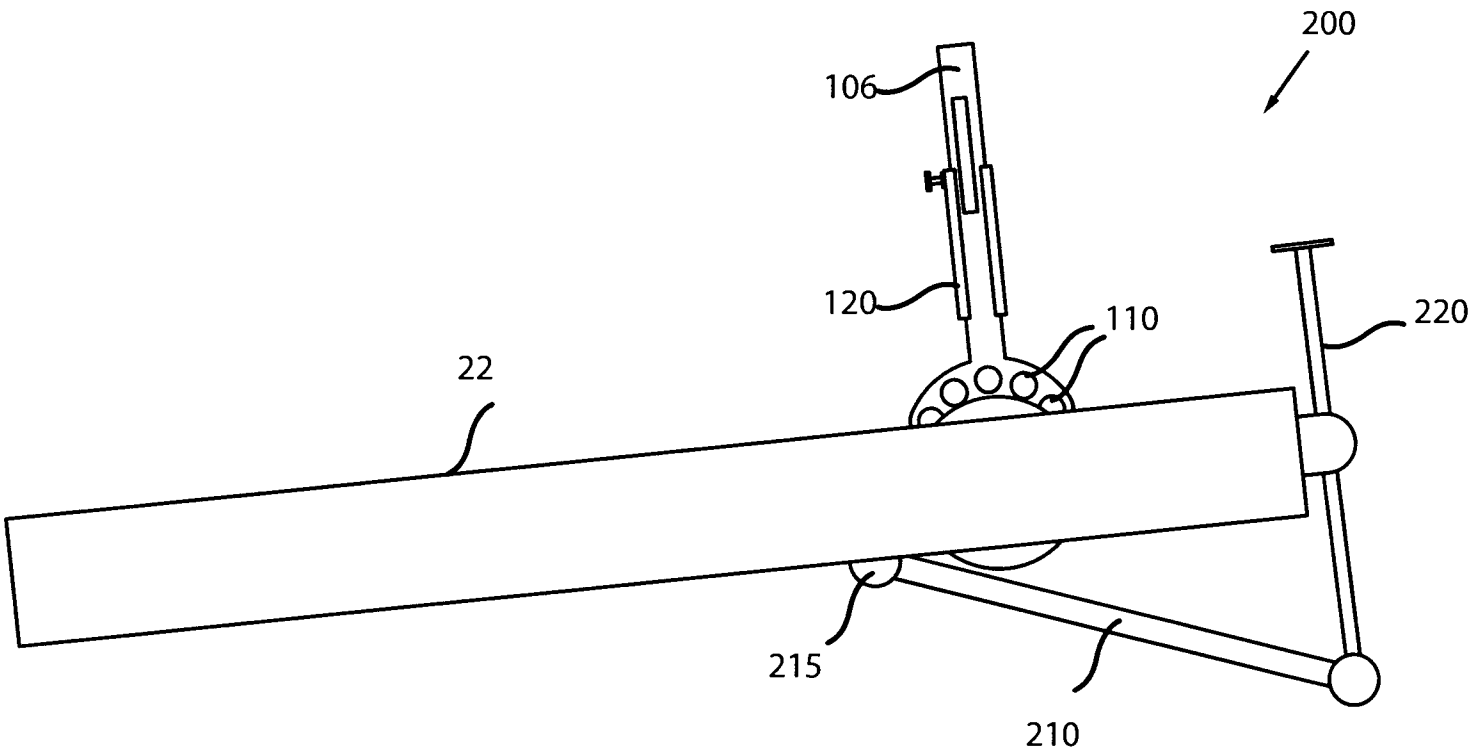
FIG. 2A is a side elevation view of the treadmill with the treadmill at a first (lowered) height.
Figure 2B:
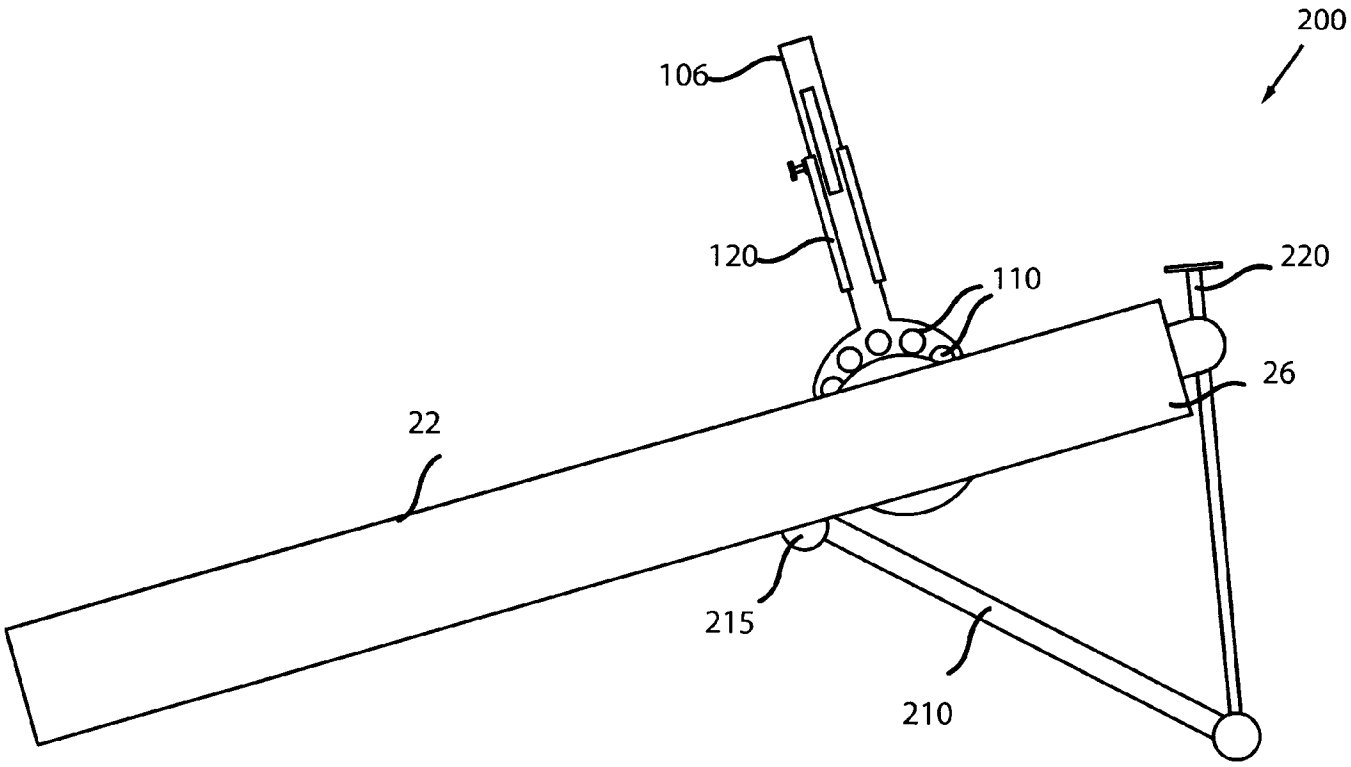
FIG. 2B is a side elevation view of the treadmill with the treadmill at a second (raised) height.
Figure 3:
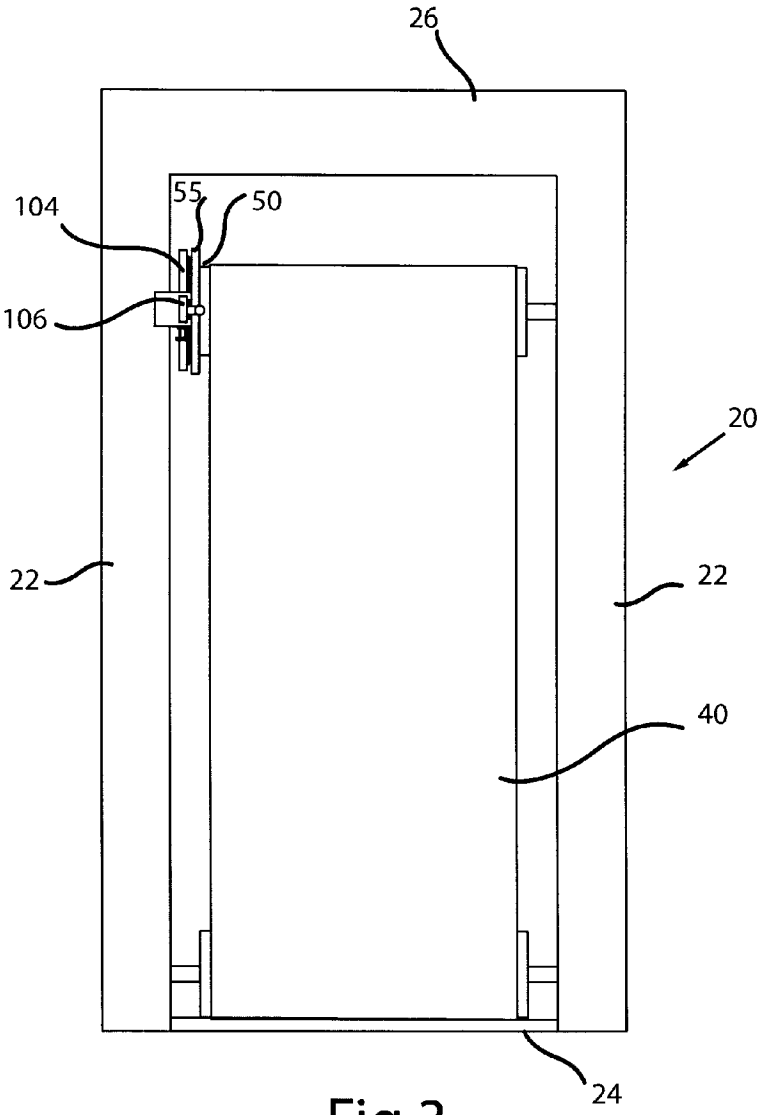
FIG. 3 is a top plan view of the treadmill.
Figure 4:
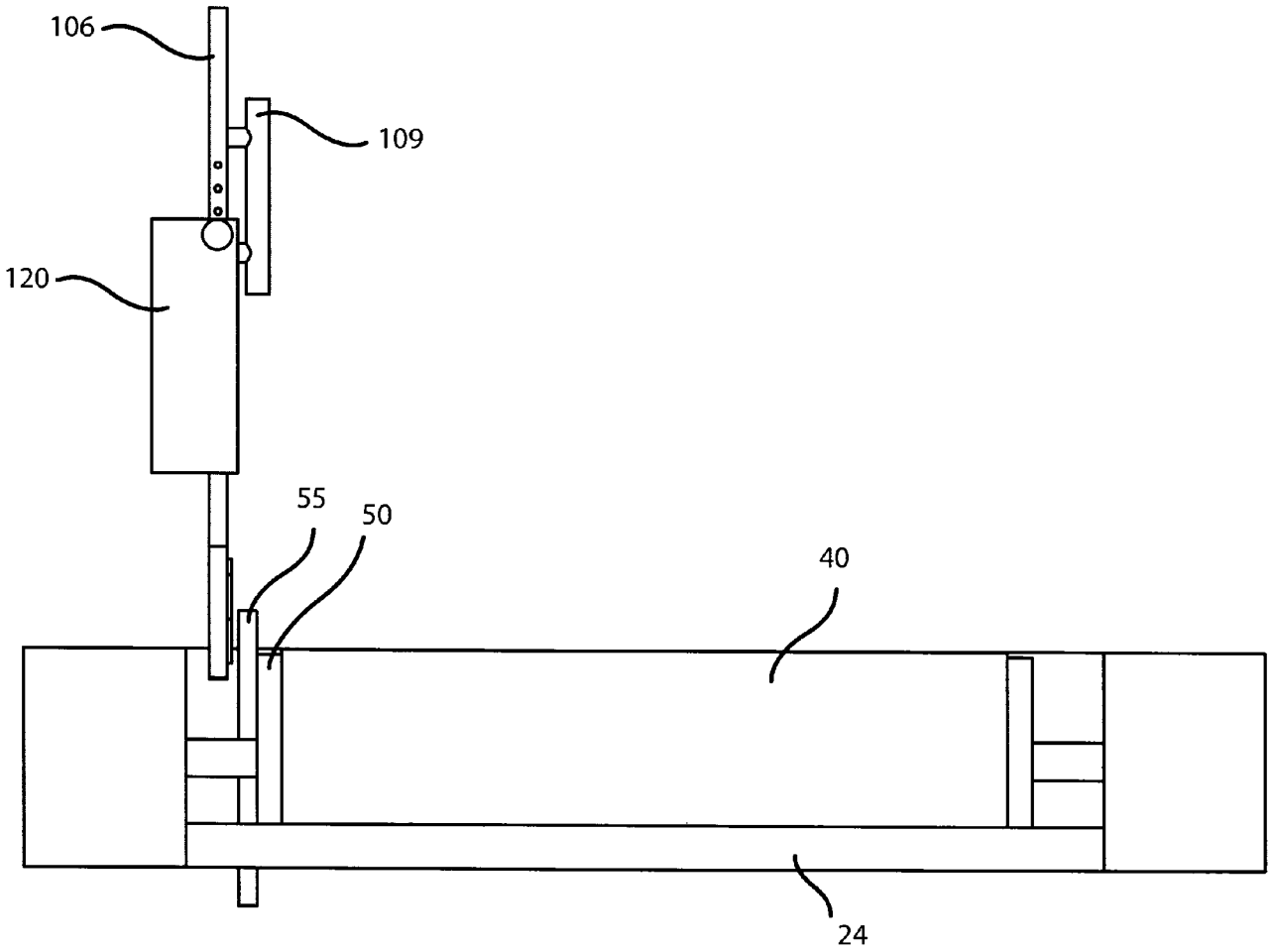
FIG. 4 is a rear view of the treadmill.
Figure 5:
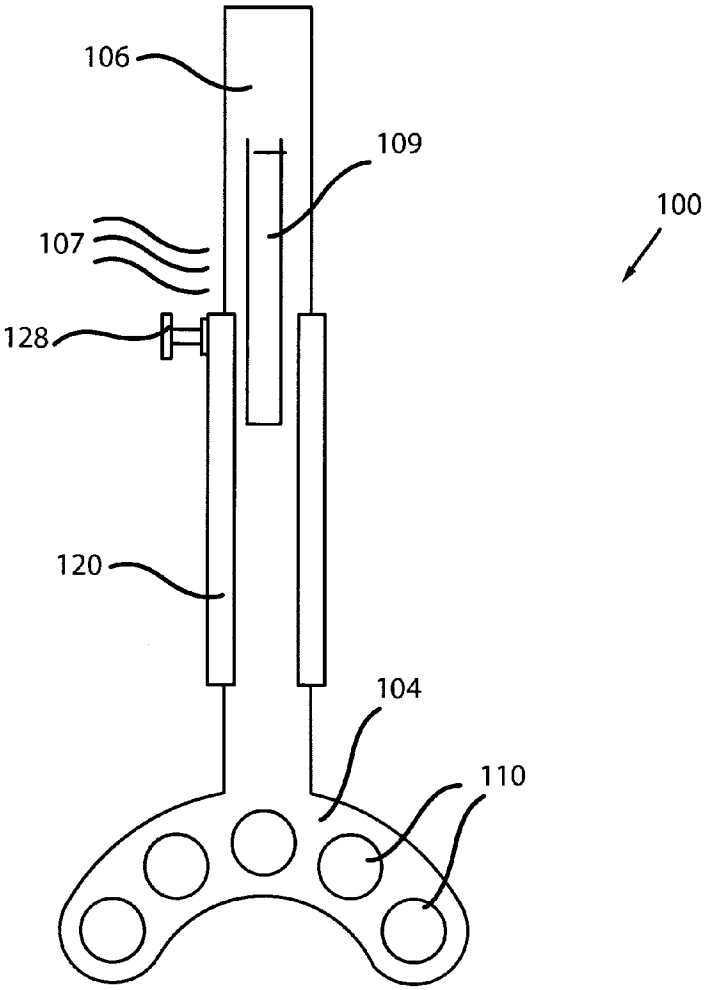
FIG. 5 is a side elevation view of the magnetic resistance unit.

In preferred embodiments, the angle of inclination of the treadmill running surface is adjusted as seen in FIGS. 2A and 2B, as follows. FIG. 2A shows the treadmill at a first (lowered) height, and FIG. 2B shows the treadmill at a second (raised) height. The height of the front of the treadmill is changed by a positioning system 200 for manually varying the angle of frame 20 and thus continuous tread 40. In one exemplary embodiment, positioning system 200 comprises a lower mount 210 pivotally connected to side members 22 at point 215. A long positioning screw 220 passes through front member 26 and is connected to lower mount 210. Simple rotation of positioning screw 220 in one direction causes front member 26 to move closer to lower mount 210 (thereby lowering the front of the frame as seen in FIG. 1A). Similarly, rotation of positioning screw 220 in an opposite direction causes front member 26 to move farther away from lower mount 210 (thereby raising the front of the frame as seen in FIG. 1B).

An advantage of using long positioning screw 120 is that a runner can reach forward and adjust the angle of inclination. In preferred embodiments, the angle of inclination can be varied from 2% to 35%. Varying the angle of inclination varies which part of the running stride is being worked on.

What is claimed is:

1. A non-motorized treadmill, comprising:

a frame;

a front roller connected to the frame;

a rear roller connected to the frame;

a continuous tread wrapping around the front and rear rollers;

a flywheel connected to one of the front or rear rollers, the flywheel controlling a rotation of the continuous tread wrapping around the front and rear rollers; and a magnetic resistance unit positioned near the flywheel to provide resistance to rotation of the flywheel and the continuous tread, wherein the magnetic resistance unit is connected to the frame and is vertically moveable to different positions near the flywheel, and wherein the different positions of the magnetic resistance unit with respect to the flywheel and the continuous tread correspond to an amount of resistance provided to rotation of the flywheel and the continuous tread.

2. The treadmill of claim 1, wherein the magnetic resistance unit comprises: a magnet support member; a plurality of magnets mounted to the magnet support member; and a rod mounted to an end of the magnet support member.

3. The treadmill of claim 2, wherein the rod is slidably connected to the frame and wherein an operator varies the position of the plurality of magnets by moving the rod to different positions on the frame.

4. A treadmill, comprising a frame;

a front roller connected to the frame;

a rear roller connected to the frame;

a continuous tread wrapping around the front and rear rollers;

a flywheel connected to one of the front or the rear rollers; and a magnetic resistance unit positioned near the flywheel to provide resistance to a rotation of the flywheel, the magnetic resistance unit comprising:

a magnet support member; a plurality of magnets mounted to the magnet support member; and a rod mounted to an end of the magnet support member, wherein the rod is slidably connected to the frame;

wherein the magnetic resistance unit is connected to the frame and is moveable to different positions near the flywheel, wherein the position of the magnetic resistance unit with respect to the flywheel corresponds to the amount of resistance provided to a rotation of the flywheel;

wherein a position of the plurality of magnets is varied by moving the rod to different positions on the frame; and wherein the magnet support member is Y-shaped and has five magnets attached thereto.

5. The treadmill of claim 1, wherein the flywheel comprises an aluminum disk mounted thereto.

6. The treadmill of claim 2, wherein the magnets are made of neodymium.

7. The treadmill of claim 1, further comprising a positioning system for manually varying an angle of the continuous tread with respect to a corresponding ground surface.

8. The treadmill of claim 7, wherein the positioning system adjusts the angle of the continuous tread by raising or lowering a front of the frame.

9. The treadmill of claim 7, wherein the positioning system comprises:

a lower mount member having proximal and distal ends, the proximal end being pivotally connected to an inwardly positioned pivot point of a side member externally positioned on the frame; and a positioning screw passing through a forward member of the frame and terminating at the distal end of the lower mount member, wherein rotation of the positioning screw causes the lower mount to pivot about the pivot point and raises or lowers the forward member of the frame.

10. The treadmill of claim 9, wherein the positioning screw can be rotated by an operator standing on the treadmill.

11. The treadmill of claim 2, wherein the rod is slidably received within a vertical beam connected to a side member that is externally positioned on the frame.

12. The treadmill of claim 11, wherein the rod further comprises a plurality of positioning sockets running lengthwise, the treadmill further comprising a positioning pin operable to be inserted into each of the positioning sockets.

13. The treadmill of claim 1, wherein the magnetic resistance unit is formed in a Y-shape.

14. A non-motorized treadmill, comprising:

a frame;

a front roller connected to a forward portion of the frame;

a rear roller connected to an aft portion of the frame;

a continuous tread surface wrapped around the front and rear rollers;

a flywheel connected to either of the front or rear rollers; and a magnetic resistance unit operatively connected to the frame and movably positioned adjacent to the flywheel;

wherein the magnetic resistance unit modulates resistance imparted to the continuous tread by moving vertically between different positions along the flywheel, wherein resistance is determined by a distance of the magnetic resistance unit from the flywheel and a portion of the flywheel enveloped by the magnetic resistance unit.

15. The treadmill of claim 14, wherein the magnetic resistance unit comprises:

a magnet support member;

a plurality of magnets mounted to the magnet support member; and a rod mounted to an end of the magnet support member, wherein an orientation and spacing between each of the magnets with respect to the flywheel further modulate the resistance.

16. The treadmill of claim 15, wherein the rod is slidably connected to the frame and wherein the position of the plurality of magnets is varied about the flywheel by moving the rod to different positions along the frame.

17. The treadmill of claim 15, wherein the magnetic resistance unit is movable at least between a raised position and a lowered position, the lowered position being defined by the plurality of magnets enveloping a complete diameter of the flywheel.

18. The treadmill of claim 14, wherein the magnetic resistance unit is movable at least between a raised position and a lowered position.

19. The treadmill of claim 18, wherein the lowered position is defined by the magnetic resistance unit enveloping a complete diameter of the flywheel.

* * * * *